US009346640B2

(12) United States Patent
Horita et al.

(10) Patent No.: US 9,346,640 B2
(45) Date of Patent: May 24, 2016

(54) SHEET FEEDER AND IMAGE FORMING APPARATUS

(71) Applicants: Hirofumi Horita, Osaka (JP); Ikuo Fujii, Osaka (JP); Mizuna Tanaka, Osaka (JP); Tomoya Tanaka, Osaka (JP); Toshikane Nishii, Osaka (JP); Masaki Narita, Tokyo (JP); Yoshitake Shimizu, Osaka (JP); Yutaka Aso, Osaka (JP); Takashi Fujimoto, Hyogo (JP)

(72) Inventors: Hirofumi Horita, Osaka (JP); Ikuo Fujii, Osaka (JP); Mizuna Tanaka, Osaka (JP); Tomoya Tanaka, Osaka (JP); Toshikane Nishii, Osaka (JP); Masaki Narita, Tokyo (JP); Yoshitake Shimizu, Osaka (JP); Yutaka Aso, Osaka (JP); Takashi Fujimoto, Hyogo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/641,944

(22) Filed: Mar. 9, 2015

(65) Prior Publication Data

US 2015/0259164 A1 Sep. 17, 2015

(30) Foreign Application Priority Data

Mar. 17, 2014 (JP) ..... 2014-053660

(51) Int. Cl.

| | |
|---|---|
| ***B65H 3/52*** | (2006.01) |
| ***B65H 5/06*** | (2006.01) |
| ***B65H 1/08*** | (2006.01) |
| ***B65H 3/06*** | (2006.01) |

(52) U.S. Cl.

CPC ..... *B65H 3/5223* (2013.01); *B65H 1/08* (2013.01); *B65H 3/0684* (2013.01); *B65H 3/5207* (2013.01); *B65H 3/5215* (2013.01); *B65H 5/068* (2013.01); *B65H 2405/1118* (2013.01)

(58) Field of Classification Search

CPC ..... B65H 3/52; B65H 3/5207; B65H 3/5215; B65H 3/5223; B65H 2405/1118

See application file for complete search history.

(56) References Cited

U.S. PATENT DOCUMENTS

| | | | | |
|---|---|---|---|---|
| 5,584,475 | A * | 12/1996 | Asada et al. | 271/121 |
| 7,128,316 | B2 * | 10/2006 | Nakano et al. | 271/121 |
| 7,455,287 | B2 * | 11/2008 | Shiohara et al. | 271/121 |
| 7,497,432 | B2 * | 3/2009 | Ikeda | 271/121 |
| 7,618,036 | B2 * | 11/2009 | Ikeda | 271/121 |
| 7,731,177 | B2 * | 6/2010 | Ikeda | 271/121 |

(Continued)

FOREIGN PATENT DOCUMENTS

| | | |
|---|---|---|
| JP | 3-249038 | 11/1991 |
| JP | 5-186081 | 7/1993 |

(Continued)

OTHER PUBLICATIONS

U.S. Appl. No. 14/533,776, filed Nov. 5, 2014.

*Primary Examiner* — Patrick Cicchino

(74) *Attorney, Agent, or Firm* — Harness, Dickey & Pierce, PLC

(57) ABSTRACT

A sheet feeder includes a feeding member to contact a sheet and feed the sheet downstream in a sheet conveyance direction, a friction pad disposed facing the feeding member to contact the feeding member, and a receiving table including a pad mount to hold a side of the friction pad opposite a nip between the friction pad and the feeding member. The friction pad includes a fixed range secured to the pad mount upstream from the nip and a movable range extending downstream the nip in the sheet conveyance direction. A first friction force of the pad mount to act on the movable range of the friction pad is smaller than a second friction force of the sheet to act on the movable range of the friction pad.

17 Claims, 16 Drawing Sheets

(56) References Cited

U.S. PATENT DOCUMENTS

| | | | | |
|---|---|---|---|---|
| 7,845,630 | B2 * | 12/2010 | Hung et al. | 271/121 |
| 8,496,241 | B2 * | 7/2013 | Osakabe et al. | 271/121 |
| 8,876,104 | B2 * | 11/2014 | Koshimura | 271/121 |
| 2008/0224385 | A1 | 9/2008 | Takahira et al. | |
| 2008/0237970 | A1 | 10/2008 | Tanaka et al. | |
| 2009/0110459 | A1 | 4/2009 | Honda et al. | |
| 2009/0315250 | A1 | 12/2009 | Kimura et al. | |
| 2010/0019440 | A1 | 1/2010 | Fujiwara et al. | |
| 2010/0059930 | A1 | 3/2010 | Tanaka et al. | |
| 2010/0221051 | A1 | 9/2010 | Yamazaki et al. | |
| 2010/0314827 | A1 | 12/2010 | Nishii et al. | |
| 2011/0115154 | A1 | 5/2011 | Fujiwara et al. | |
| 2011/0204556 | A1 | 8/2011 | Takahira et al. | |
| 2011/0217058 | A1 | 9/2011 | Honda et al. | |
| 2012/0043714 | A1 * | 2/2012 | Hamaguchi et al. | 271/10.09 |
| 2012/0061907 | A1 | 3/2012 | Matsuyama et al. | |
| 2012/0063829 | A1 | 3/2012 | Matsuyama et al. | |
| 2012/0104690 | A1 | 5/2012 | Tanaka et al. | |
| 2012/0146281 | A1 | 6/2012 | Nishii et al. | |
| 2013/0043647 | A1 | 2/2013 | Fujii et al. | |
| 2014/0049000 | A1 | 2/2014 | Kimura et al. | |
| 2014/0077444 | A1 | 3/2014 | Fujii et al. | |
| 2014/0091518 | A1 | 4/2014 | Nishii et al. | |
| 2014/0319759 | A1 | 10/2014 | Fujii et al. | |

FOREIGN PATENT DOCUMENTS

| | | |
|---|---|---|
| JP | 5-213467 | 8/1993 |
| JP | 10-017171 | 1/1998 |
| JP | 2012-062196 | 3/2012 |

* cited by examiner

SHEET FEEDER AND IMAGE FORMING APPARATUS

CROSS-REFERENCE TO RELATED APPLICATIONS

This patent application is based on and claims priority pursuant to 35 U.S.C. §119(a) to Japanese Patent Application No. 2014-053660, filed on Mar. 17, 2014, in the Japan Patent Office, the entire disclosure of which is hereby incorporated by reference herein.

BACKGROUND

1. Technical Field

Embodiments of the present invention generally relate to a sheet feeder and an image forming apparatus, such as a copier, a facsimile machine, a printer, a plotter, and a multi-function peripheral having at least two of copying, printing, facsimile transmission, plotting, and scanning capabilities; or an inkjet recording device, that includes the sheet feeder.

2. Description of the Related Art

One of qualities of image forming apparatuses such as copiers, facsimile machines, and printers, is sheet conveyance quality. Currently, various types of sheets (i.e., recording media) are used in image forming apparatuses, and there is a demand for quality improvement in sheet feeding and separation. For high-quality sheet feeding and separation, RF (Roller Friction) type sheet feeding and FRR (Feed and Reverse Roller) type sheet feeding are known.

Although RF type and FRR type sheet feeding are capable of high quality sheet feeding and separation, the cost is higher and reduction in size is difficult. By contrast, sheet feeders using a friction pad (hereinafter "friction pad type") is known as relatively inexpensive and compact.

In the friction pad type, a table to which a friction pad (i.e., a separation pad) is attached is disposed beneath a feeding roller. In the friction pad type, a sheet set out by the feeding roller is caused to contact the separation pad to inhibit feeding of multiple sheets at a time (multifeed) by friction between the sheet and the separation pad. Then, only the top sheet in contact with the feeding roller is separated from the rest and transported to an image forming unit.

The separation pad is made of a material smaller in friction coefficient than a material of the feeding roller. For example, natural rubber, cork, leather, urethane, synthetic rubber, or the like is used singly.

SUMMARY

An embodiment of the present invention provides a sheet feeder that includes a feeding member to contact a sheet and feed the sheet downstream in a sheet conveyance direction, a friction pad disposed facing the feeding member to contact the feeding member, and a receiving table including a pad mount to hold a side of the friction pad opposite a nip between the friction pad and the feeding member. The friction pad includes a fixed range secured to the pad mount and a movable range movable in the sheet conveyance direction. The fixed range is upstream from the nip, and the movable range extends downstream from the nip in the sheet conveyance direction. A first friction force of the pad mount that acts on the movable range of the friction pad is smaller than a second friction force of the sheet that acts on the movable range of the friction pad.

In another embodiment, an image forming apparatus includes a sheet tray to contain multiple sheets of recording media, the above-described sheet feeder, an image forming unit to form an image on the sheet, and an ejection device to eject the sheet outside the image forming apparatus.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
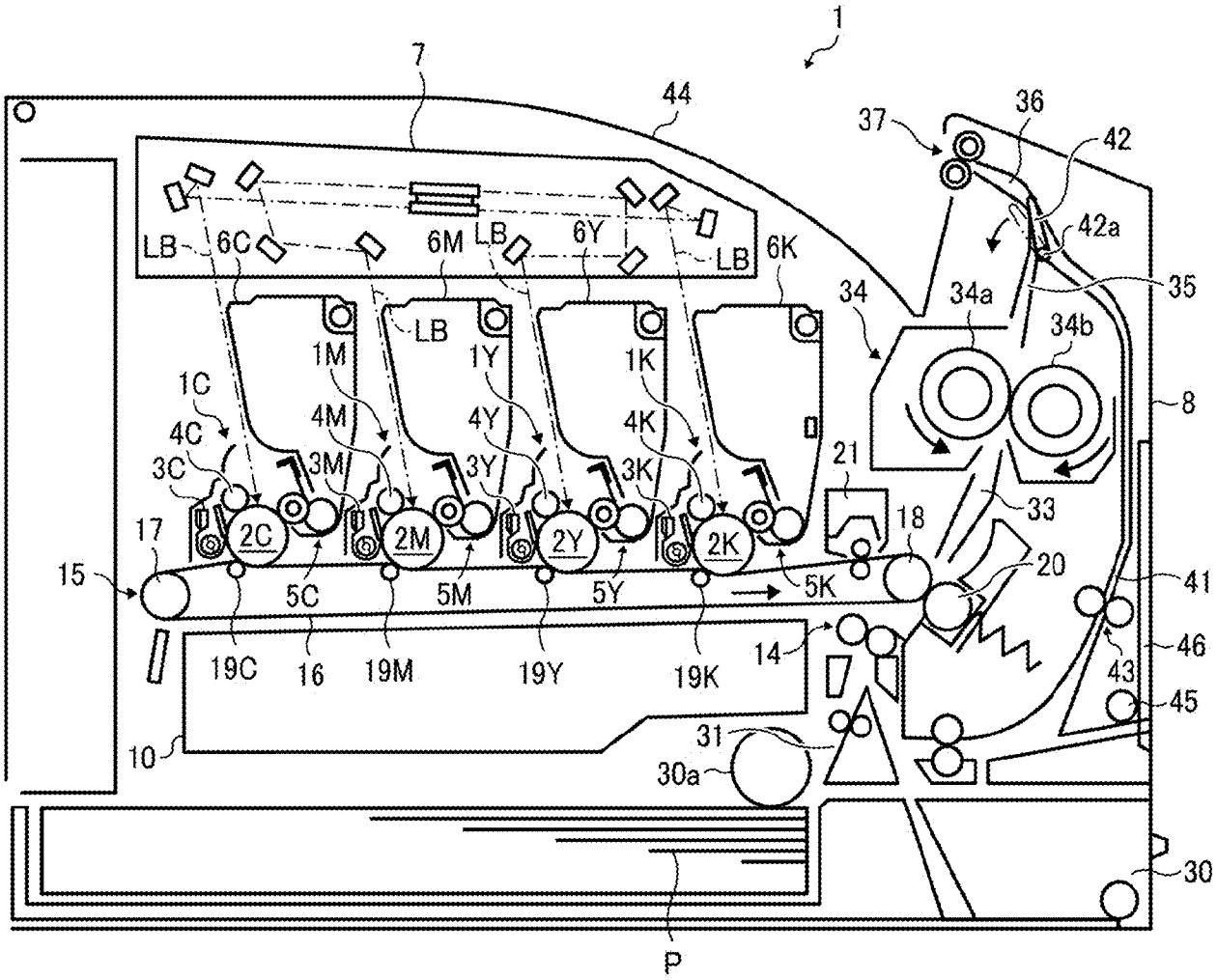
FIG. 1 is a schematic view of an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

It is to be understood that an identical or similar reference character is given to identical or corresponding parts throughout the drawings, and redundant descriptions are omitted or simplified below. The dimension, material, shape, relative positions of components mentioned below are examples and embodiments are not limited thereto unless otherwise specified.

It is to be noted that the term "sheet" includes not only paper but also any material called recording medium, recording paper, or a recording sheet, such as an overhead projector (OHP) sheet, textile, and the like, to which toner or ink adheres. Additionally, the term "sheet" include not only flexible materials but also hard plates and relatively thick materials.

Referring now to the drawings, a configuration of a multicolor laser printer is described below as an image forming apparatus according to an embodiment.

FIG. 1 is a schematic view of an image forming apparatus 1 to which a sheet feeder according to an embodiment is incorporated.

The image forming apparatus 1 includes four process units 1K, 1Y, 1M, and 1C (i.e., image forming units) to form images using black (K), yellow (Y), magenta (M), and cyan (C) developer corresponding to decomposed color components of full-color images. It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

The process units 1K, 1Y, 1M, and 1C respectively include toner bottles 6K, 6Y, 6M, and 6C containing different color toners. Since the process units 1K, 1Y, 1M, and 1C have a similar structure except the color of toner, the process unit 1K is described as a representative, and the descriptions of other process units 1 are omitted.

The process unit 1K includes a photoconductor drum 2K serving as an image bearer, a drum cleaning device 3K, a discharger, a charging device 4K, and a developing device 5K. The process unit 1K is removably installed in an apparatus body of the image forming apparatus 1 so that consumables are replaceable at a time.

An exposure device 7 is disposed above the process units 1K, 1Y, 1M, and 1C. The exposure device 7 emits laser light from a laser diode according to image data.

A transfer device 15 is disposed beneath the process units 1K, 1Y, 1M, and 1C in the configuration illustrated in FIG. 1. Primary-transfer rollers 19K, 19Y, 19M, and 19C are disposed in contact with an intermediate transfer belt 16 and to face the photoconductor drums 2K, 2Y, 2M, and 2C, respectively.

The intermediate transfer belt 16 is looped around the primary-transfer rollers 19K, 19Y, 19M, and 19C, a driving roller 18, and a driven roller 17 and rotates.

A secondary-transfer roller 20 is disposed in contact with the intermediate transfer belt 16 and to face the driving roller 18. It is to be noted that, when the photoconductor drums 2 are called primary image bearers, the intermediate transfer belt 16 is called a secondary image bearer to bear a synthesized image made from images formed on the respective photoconductor drums 2.

A belt cleaner 21 is situated downstream from the secondary-transfer roller 20 in a direction in which the intermediate transfer belt 16 rotates. Additionally, a cleaning backup roller faces the belt cleaner 21 via the intermediate transfer belt 16.

A sheet feeding tray 30 is disposed in a lower portion of the image forming apparatus 1 and capable of containing a bundle of sheets P. The sheet feeding tray 30 is removably installed in the image forming apparatus 1 so that the sheets P are placed in the sheet feeding tray 30. A feeding roller 30*a* serving as a feeding member is positioned above the sheet feeding tray 30 being installed in the image forming apparatus 1. The feeding roller 30*a* sends out the sheet P from the sheet feeding tray 30 to a sheet feeding path 31.

A pair of timing rollers 14 is disposed adjacent to and upstream from the secondary-transfer roller 20 to suspend conveyance of the sheet P from the sheet feeding tray 30. Then, the sheet P is slackened on the leading end side in a sheet conveyance direction.

The slackened sheet P is forwarded to a secondary-transfer nip between the secondary-transfer roller 20 and the driving roller 18, timed to coincide with transfer of a toner image on the intermediate transfer belt 16. In the secondary-transfer nip, the toner image is transferred from the intermediate transfer belt 16 onto a designated position on the sheet P with a higher degree of accuracy.

Then, the sheet P is transported through a conveyance path 33 situated above the secondary-transfer nip between the secondary-transfer roller 20 and the driving roller 18 in FIG. 1. A fixing device 34 is provided at an upper end of the conveyance path 33 in FIG. 1.

The fixing device 34 includes a fixing roller 34*a* in which a heat source such as a halogen lamp is provided and a pressure roller 34*b* pressing against the fixing roller 34*a*, and a nip therebetween is called a fixing nip. The sheet P is clamped in the fixing nip. A conveyance path 35 extends above the fixing device 34 in FIG. 1 and branches into a paper ejection path 36 and a reversal path 41.

A route switch 42 is provided in a branching portion thereof. The route switch 42 pivots about a pivot shaft 42*a*. At an opening end of the paper ejection path 36, a pair of paper ejection rollers 37 are disposed.

The reversal path 41 converges into the sheet feeding path 31 at an end opposite the branching portion. Additionally, a pair of conveyance rollers 43 is disposed midway in the reversal path 41. An upper face of the image forming apparatus 1 is recessed to an inner side of the image forming apparatus 1 and serves as an output tray 44.

A toner container 10, serving as a powder container and removably installed in the apparatus body, is provided between the transfer device 15 and the sheet feeding tray 30.

In the present embodiment, for the purpose of sheet conveyance, a predetermined length is secured from the feeding roller 30*a* to the secondary-transfer roller 20. The toner container 10 is disposed in a dead space caused by that distance to keep the entire image forming apparatus compact.

A cover 8 is provided above the sheet feeding tray 30 and on a front side to which the sheet feeding tray 30 is pulled out. The cover 8 is openable to check an interior of the image forming apparatus 1. To the cover 8, a feeding roller 45 and a bypass tray 46 for bypass feeding are provided.

It is to be noted that the image forming apparatus 1 according to the present embodiment is not limited to the laser printer but can be a copier, a facsimile machine, a printer, a plotter, and a multifunction peripheral having at least two of copying, printing, facsimile transmission, plotting, and scanning capabilities; or an inkjet recording device.

Referring to FIG. 1, operation of the image forming apparatus 1 according to the present embodiment is described below.

Initially, single-side printing is described. Referring to FIG. 1, the feeding roller 30*a* rotates in response to a sheet feeding signal from a controller of the image forming apparatus 1. Then, the feeding roller 30*a* separates the top sheet P from the bundle of sheets placed in the sheet feeding tray 30 and forwards the sheet P to the sheet feeding path 31.

When the leading end of the sheet P fed by the feeding roller 30*a* reaches the nip between the timing rollers 14, the sheet P is slackened and kept standby. Then, sheet conveyance is suspended for the timing of transfer of the toner image from the intermediate transfer belt 16, and skew of the sheet P at the leading end is corrected.

In the case of bypass feeding, a bundle of sheets placed on the bypass tray 46 are fed one by one from the top by the feeding roller 45 and transported through a part of the reversal path 41 to the timing rollers 14. Operations thereafter are similar to those of sheet feeding from the sheet feeding tray 30.

As to image formation, operations of the process unit 1K is described as a representative. The charging device 4K charges a surface of the photoconductor drum 2K uniformly to a high potential.

The exposure device 7 emits a laser beam L onto the surface of the photoconductor drum 2K according to image data. On the surface of the photoconductor drum 2K, a portion irradiated with the laser beam is reduced in potential, thus forming an electrostatic latent image.

The developing device 5K supplies black toner from the toner bottle 6K onto the portion of the photoconductor drum 2K bearing the electrostatic latent image. Thus, a black toner image is formed on the photoconductor drum 2K (i.e., a developing process). The toner image is then transferred from the photoconductor drum 2K onto the intermediate transfer belt 16 (i.e., a primary-transfer process).

The drum cleaning device 3K removes toner remaining on the surface of the photoconductor drum 2K after the primary-transfer process. The toner thus removed is transported by a collected-toner conveyor to a collected-toner container inside the process unit 1K. The discharger removes electricity remaining on the surface of the photoconductor drum 2K cleaned by the drum cleaning device 3K.

Toner images are formed on the respective photoconductor drum 2 in other process units 1 as well, and respective color toners are superimposed one on another on the intermediate transfer belt 16.

When the superimposed toner images (i.e., a multicolor image) reaches the secondary-transfer nip between the secondary-transfer roller 20 and the driving roller 18 while the intermediate transfer belt 16 rotates, the superimposed toner images are transferred onto the sheet P forwarded by the timing rollers 14.

As described above, the sheet P is forwarded to the secondary-transfer nip, timed to coincide with transfer timing of the toner images on the intermediate transfer belt 16. In the secondary-transfer nip, the toner image is transferred from the intermediate transfer belt 16 onto the designated position on the sheet P with a higher degree of accuracy.

Then, the sheet P is transported through the conveyance path 33 to the fixing device 34, where the toner image is fixed on the sheet P while clamped and heated by the fixing roller 34*a* and the pressure roller 34*b*. The fixing device 34 sends out the sheet P carrying the fixed toner image to the conveyance path 35.

At a timing at which the fixing device 34 sends out the sheet P, the route switch 42 is at a position indicated by solid lines to open an upper end of the conveyance path 35 in FIG. 1. Then, the sheet P is transported via the conveyance path 35 to the paper ejection path 36. The paper ejection rollers 37 clamps the sheet P therebetween and rotate, thereby ejecting the sheet P to the output tray 44. Thus, single-side printing is completed.

Next, duplex printing is described.

Similar to single-side printing, the fixing device 34 sends out the sheet P to the paper ejection path 36. In duplex printing, the paper ejection rollers 37 rotate and expose the sheet P partly outside the image forming apparatus 1.

When a trailing end of the sheet P passes by the branching portion to the paper ejection path 36, the route switch 42 pivots about the pivot shaft 42*a* as indicated by broken lines in FIG. 1. Thus, the upper end of the conveyance path 35 is closed. When the upper end of the conveyance path 35 is closed, nearly simultaneously, the paper ejection rollers 37 rotate in reverse to transport the sheet P to an inner side of the image forming apparatus 1, to the reversal path 41.

The sheet P is transported through the reversal path 41 via the conveyance rollers 43 to the timing rollers 14. The timing rollers 14 forward the sheet P to the secondary-transfer nip, timed to coincide with transfer of the toner image from the intermediate transfer belt 16.

While the sheet P passes through the secondary-transfer nip, the secondary-transfer roller 20 and the driving roller 18 transfer the toner image onto a second side (backside) of the sheet P. Then, the sheet P is transported through the conveyance path 33 to the fixing device 34, and the toner image is fixed on the sheet P by the fixing roller 34*a* and the pressure roller 34*b* with head and pressure. The fixing device 34 sends out the sheet P carrying the fixed toner image to the conveyance path 35.

At a timing at which the fixing device 34 sends out the sheet P, the route switch 42 is at a position indicated by solid lines to open an upper end portion of the conveyance path 35 in FIG. 1. Then, the sheet P is transported via the conveyance path 35 to the paper ejection path 36. The paper ejection rollers 37 clamps the sheet P therebetween and rotate, thereby ejecting the sheet P to the output tray 44. Thus, duplex printing is completed.

After the toner image is transferred therefrom, the belt cleaner 21 removes toner remaining on the intermediate transfer belt 16. The toner thus removed is transported by a waste-toner conveyor to the toner container 10.

Description are given below of a comparative sheet feeder employing a friction pad.

Figure 2A:
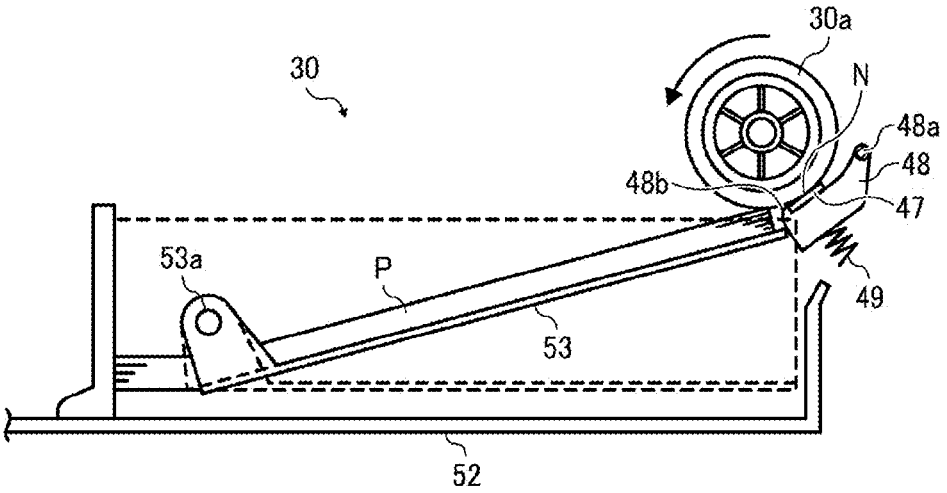
FIG. 2A is a side view of a sheet feeding tray according to an embodiment.
Figure 2B:
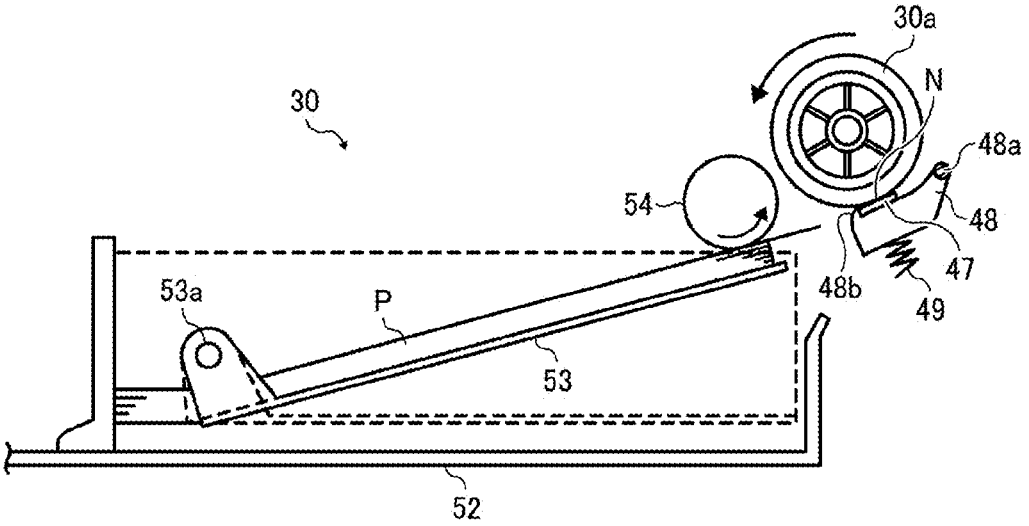
FIG. 2B is a side view of a sheet feeding tray according to another embodiment.

FIGS. 2A and 2B are views of a typical sheet feeder of friction pad type.

The sheet feeder is provided on a front side (on the right in FIGS. 2A and 2B) of the sheet feeding tray 30 in a sheet conveyance direction, in which sheets are fed and transported.

The sheet feeding tray 30 includes a box 52 including an open top, a sheet table 53 (i.e., a sheet mounting face) on a bottom of the box 52, on which sheets are mountable, and a shaft 53*a* to support a trailing end of the sheet table 53 in the sheet feeding direction. The shaft 53*a* supports the sheet table 53 pivotably in a vertical direction. It is to be noted that aspects of embodiments are applicable to configurations in which the receiving table 48 moves parallel in the vertical direction.

The sheet feeder illustrated in FIG. 2A includes the feeding roller 30*a* serving as a feeding member, a receiving table 48, and a spring 49 to urge the receiving table 48 upward. The receiving table 48 includes a support shaft 48*a* situated at a downstream end in the sheet conveyance direction and supported by a frame of the apparatus body. The feeding roller 30*a* contacts the receiving table 48 and a leading end portion (front side) of the sheet P in the sheet conveyance direction.

The receiving table 48 is vertically pivotable about the support shaft 48*a*. A separation pad 47 serving as a friction pad is attached to an upper face of the receiving table 48, and the separation pad 47 is caused to contact the feeding roller 30*a* by the spring 49. The separation pad 47 is planar and made of or includes an elastic body such as rubber, a mixture of rubber and cork, foamed urethane, or silicon. An example of rubber is elastomer.

By pressing the receiving table 48 against the feeding roller 30*a*, the spring 49 keeps a separation nip N (a contact portion) between the separation pad 47 and the feeding roller 30*a* under a predetermined pressure. Here, when $\mu r$ represents friction force between the feeding roller 30*a* and the sheet P, $\mu s$ represents friction force between the sheets P, and $\mu f$ represents friction force between the sheet P and the separation pad 47, a relation $\mu r > \mu f > \mu s$ is attained in the sheet feeder to separate, with friction, the top sheet P from the rest and send out the top sheet P.

The configuration illustrated in FIG. 2B includes an auxiliary roller 54 dedicated for picking up the sheet P. The auxiliary roller 54 rotates in conjunction with the feeding roller 30*a* to forward the sheet P on the top to the separation nip N.

Figure 3A:
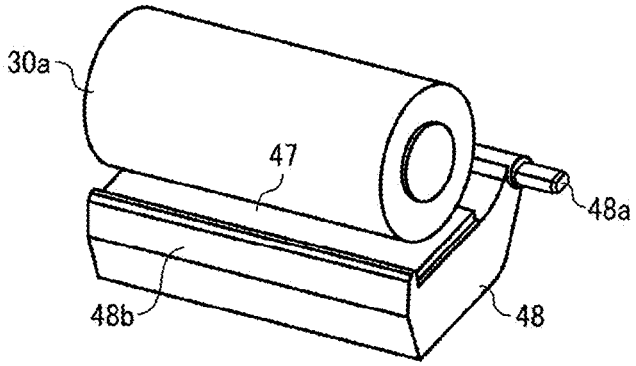
FIG. 3A is a perspective view illustrating a basic configuration of a sheet feeder according to an embodiment.
Figure 3B:
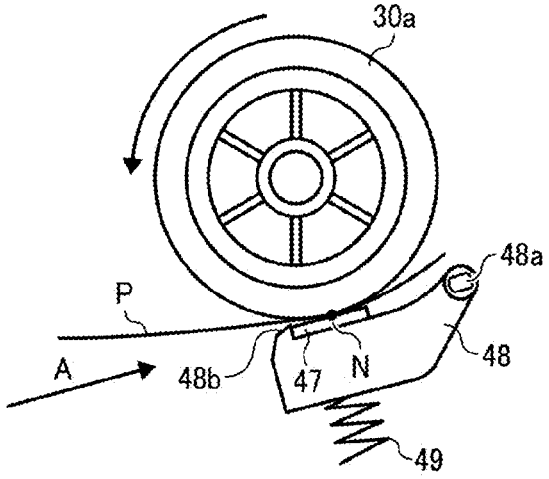
FIG. 3B is a side view of the sheet feeder illustrated in FIG. 3A.
Figure 3C:
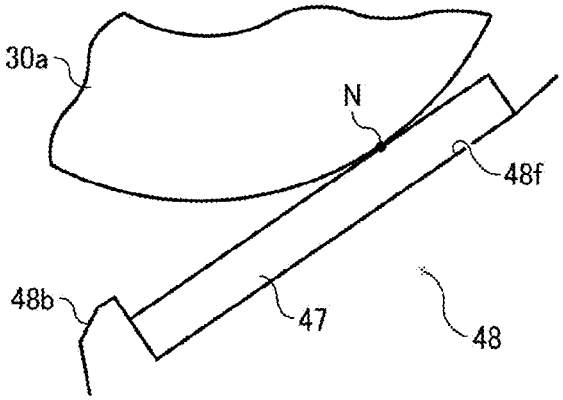
FIG. 3C is an enlarged side view of a separation nip in the sheet feeder illustrated in FIG. 3A.

FIGS. 3A through 3C illustrate the receiving table 48.

A part of the receiving table 48 positioned upstream from the separation pad 47 in the sheet conveyance direction serves as a front guide 48*b*.

The front guide 48*b* guides the leading end (i.e., front end) of the sheet P to the sheet feeding path 31. The sheet P fed from the sheet feeding tray 30 is guided by the front guide 48*b* to the separation nip N. The front guide 48*b* is greater in height than the separation pad 47 to prevent the sheet P from being caught by the upstream end of the separation pad 47 in the sheet conveyance direction.

The upper side of the top sheet P of the bundle of sheets placed on the sheet feeding tray 30 is pressed to either the feeding roller 30*a* or the auxiliary roller 54, and the sheets P are transported one by one from the top by the feeding roller 30*a* or the auxiliary roller 54. When multiple sheets P are fed, the multiple sheets P are clamped in the separation nip N.

As described above, since the separation nip N is kept under the pressure by the spring 49, only the top sheet P is frictionally separated from the bundle of sheets due to the relation of $\mu r > \mu f > \mu s$.

In the separation pad type sheet feeder described above, it is possible that, during separation and feeding of a sheet having a relatively large friction coefficient, stick-slip, meaning that two objects repeatedly stick to and slip on each other, occurs, and the sheet P is intermittently transported. That, is, in separating the sheet P, the receiving table 48 vibrates (due to stick-slip) in the sheet conveyance direction due to friction between the separation pad 47 and the sheet P. Stick-slip causes the sheet to vibrate and may result in harsh noise (i.e., pad noise).

Although multifeed of sheets and noise may be reduced by using multiple pads different in friction coefficient, this approach is not directly effective in suppressing vibration in the sheet conveyance direction due to stick-slip. Use of multiple pads different in friction coefficient may increase the cost and hinder reliable sheet separation since a sheet separation face is complicated.

In view of the foregoing, noise is suppressed in sheet feeders according to first through seventh embodiments described below.

First Embodiment

Figure 4A:
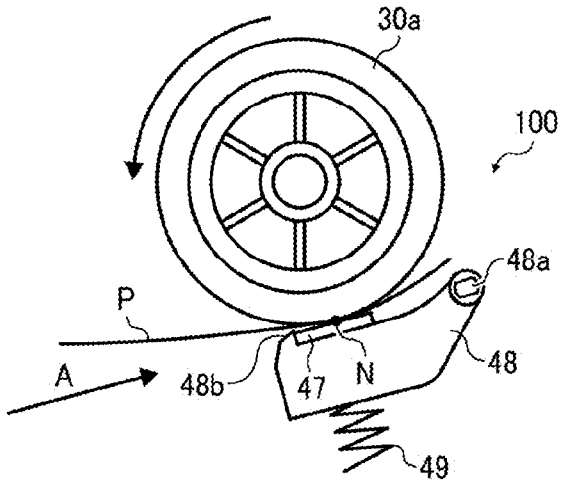
FIG. 4A is a side view of a sheet feeder according to a first embodiment.
Figure 4B:
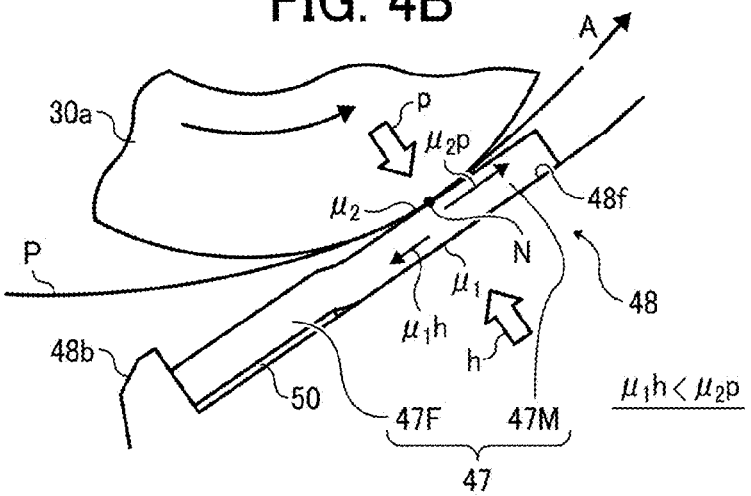
FIGS. 4B and 4C are enlarged side views of a separation nip in the sheet feeder illustrated in FIG. 4A.
Figure 4C:
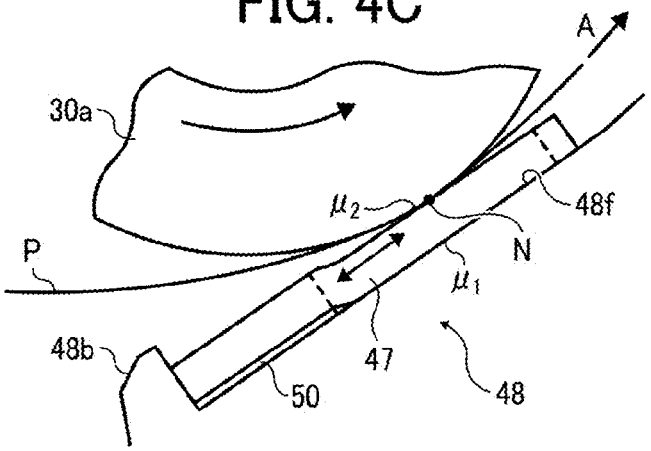

FIGS. 4A, 4B, and 4C are views of a sheet feeder 100 according to a first embodiment. It is to be noted that arrow A represents the sheet conveyance direction.

As illustrated in FIG. 4A, the sheet feeder 100 according to the first embodiment is basically similar in structure to the above-described typical separation pad sheet feeder in FIGS. 2A through 3C. That is, the sheet feeder 100 in FIG. 4A includes the feeding roller 30*a* to feed the sheet P, the separation pad 47 to separate one by one the sheets P, the receiving table 48 to hold the separation pad 47, and the spring 49 to urge the receiving table 48 to the feeding roller 30*a*.

FIG. 4B is an enlarged view of the separation nip N and adjacent portion illustrated in FIG. 4A.

In the first embodiment, an upstream portion of the separation pad 47 upstream from the contact portion (i.e., the separation nip N) between the feeding roller 30*a* and the separation pad 47 in the sheet conveyance direction is fixed in position (secured) to the receiving table 48 with double-sided adhesive tape 50. That is, a range of the separation pad 47 overlapped with the double-sided adhesive tape 50 is fixed to the receiving table 48 (i.e., a fixed range 47F in FIG. 4B), and the separation pad 47 includes a movable range 47M downstream from the fixed range 47F.

The separation pad 47 is capable of elastic deformation, expansion, and contraction receiving load. The separation pad 47 is made of or includes an elastic body such as rubber, a mixture of rubber and cork, foamed urethane, or silicon.

The face (i.e., an upper face) of the separation pad 47 that contacts the feeding roller 30*a* is referred to as a separation face, and the opposite face (i.e., a lower face) is referred to as a supported face. The supported face of the separation pad 47 receives a first friction force $\mu_1 h$ from a pad mount 48*f* of the receiving table 48. Additionally, the separation face of the separation pad 47 receives second friction force $\mu_2 p$ from the sheet P.

Here, reference characters "p" represents pressure of the separation nip N, and h represents force that acts on the lower face of the movable range 47M of the separation pad 47 perpendicularly from the pad mount 48*f* of the receiving table 48, which is hereinafter "perpendicular force h". The pressure p equals the force h basically except cases where there is force from an element other than the separation pad 47, for example, due to retentivity of sheet, such as curvature of paper. Further, reference characters $\mu_1$ represents a friction coefficient between the supported face of the separation pad 47 and the pad mount 48*f*, and $\mu_2$ represents a friction coefficient between the separation face of the separation pad 47 and the sheet P. The supported face of the separation pad 47, the pad mount 48*f*, and the separation face of the separation pad 47 are configured so that the first friction force $\mu_1 h$ is smaller than the second friction force $\mu_2 p$ ($\mu_1 < \mu_2$ in the case of p=h).

Specifically, the first friction force $\mu_1 h$ can be made smaller than the second friction force $\mu_2 p$ by one of:

1) making the separation face and the supported face having different surface properties when molding the separation pad 47;

2) using a double-layered pad;

3) applying lubricant, such as oil, grease, quick-drying fluorinated lubricant, or the like, to the supported face of the separation pad 47;

4) using a highly slidable material for the receiving table 48; and 5) by disposing the movable range 47M of the separation pad 47 to bounce up by resilience of the separation pad 47 itself, thereby setting the perpendicular force h smaller than the pressure p of the separation nip N (h<p).

When the fixed range 47F of the separation pad 47 or the double-sided adhesive tape 50 is positioned upstream from the separation nip N, the difference between the first friction force $\mu_1 h$ and the second friction force $\mu_2 p$ enables the separation pad 47 to expand and contract between the fixed range 47F and the separation nip N in the sheet conveyance direction, indicated by arrow A, as illustrated in FIG. 4C. Additionally, the relation that the first friction force $\mu_1 h$ between the supported face of the separation pad 47 and the receiving table 48 is lower than the second friction force $\mu_2 p$ between the sheet P and the separation face of the separation pad 47 ($\mu_1 < \mu_2$ in the case of p=h) makes it easier for the movable range 47M of the separation pad 47 to move in the sheet conveyance direction relative to the receiving table 48.

Figure 5A:
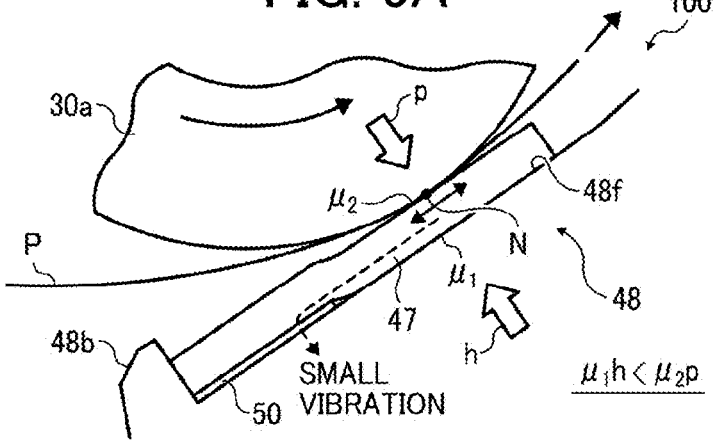
FIG. 5A is a side view of the sheet feeder according to the first embodiment.

With these two features, the movable range 47M of the separation pad 47 expands and contracts to move in the sheet conveyance direction in separation of sheets. Accordingly, as illustrated in FIG. 5A, the vibration arising in the separation nip N is inhibited from being transmitted directly to the receiving table 48, thereby suppressing vibration.

Figure 5B:
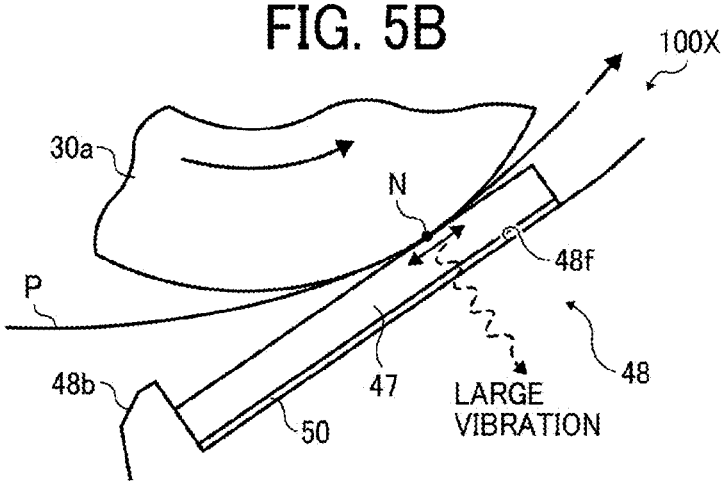
FIG. 5B is a side view of a comparative sheet feeder.
Figure 5C:
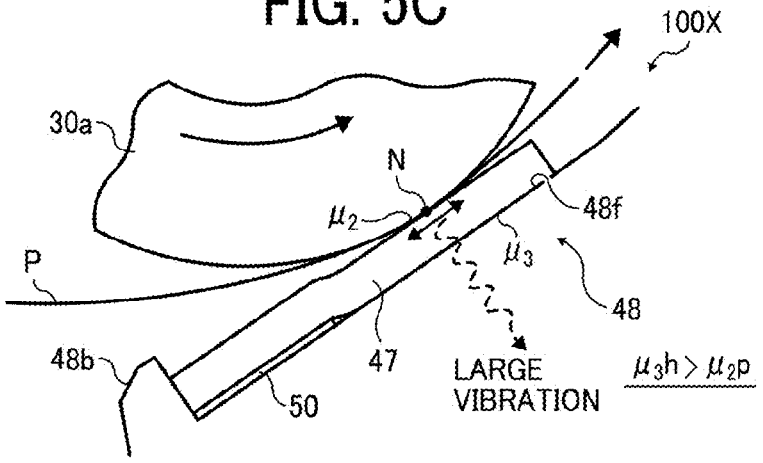
FIG. 5C is a side view of another comparative sheet feeder.

By contrast, in a comparative sheet feeder 100X illustrated in FIG. 5B in which the separation pad 47 is fixed to the receiving table 48 entirely in the sheet conveyance direction and in another comparative sheet feeder 100X illustrated in FIG. 5C in which a third friction force $\mu_3 h$ between the supported face of the separation pad 47 and the receiving table 48 is greater than the second friction force $\mu_2 p$ between the sheet P and the separation face of the separation pad 47, vibration is not suppressed since the vibration of the separation pad 47 is transmitted directly to the receiving table 48.

It is possible that noise in a separating portion to separate the sheet P, including the receiving table 48, is significantly affected by eigenfrequency of components of the separating portion. For example, in some cases, when changes in the second friction force $\mu_2 p$ (i.e., vibration frequency) between the separation pad 47 and the sheet P in the separation nip N approach to the eigenfrequency of each of the separation pad 47 and the receiving table 48, resonance is caused between the separation pad 47 and the receiving table 48, thereby amplifying vibration. As a result, noise occurs. Generally, to address noise caused by such a mechanism, the eigenfrequency thereof is changed, for example, by adding a weight to the receiving table 48.

This approach, however, makes the sheet feeder heavier and makes it difficult to keep the sheet feeder compact. By contrast, according to the present embodiment, the manner in which the separation pad 47 is secured to the receiving table 48 is changed to change rigidity between the separation pad 47 and the receiving table 48. Consequently, the eigenfrequency of the separating portion of the sheet feeder 100 is changed.

With this feature, point of resonance is shifted relative to the force transmitted from the separation pad 47, thereby inhibiting vibration and generation of noise. This configuration obviates the space necessary for the weight. Accordingly, noise caused by resonance is suppressed by a compact and lightweight structure.

Additionally, in the comparative sheet feeder 100X, in which the separation pad 47 is fully fixed to the receiving table 48 as illustrated in FIG. 5B, the point of contact between the separation pad 47 and the feeding roller 30*a* does not change, and sheets are separated only at a single point. Accordingly, wear due to friction of the separation pad 47 is localized.

Localized wear of the separation pad 47 can causes inconveniences. For example, the area of contact between the feeding roller 30*a* and the separation pad 47 in the separation nip N increases, and wear of the separation face in the separation nip N in a normal direction increases in depth. Accordingly, drag in the sheet conveyance direction against the sheet P increases, causing failure in feeding. Additionally, contact between the feeding roller 30*a* and the separation pad 47 in the separation nip N becomes unstable, thereby generating noise.

Figure 6A:
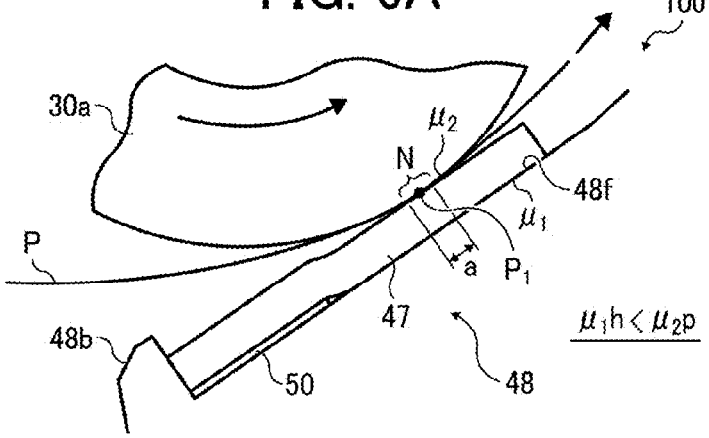
FIG. 6A is a side view of the sheet feeder according to the first embodiment, in a state before a friction pad is expanded.
Figure 6B:
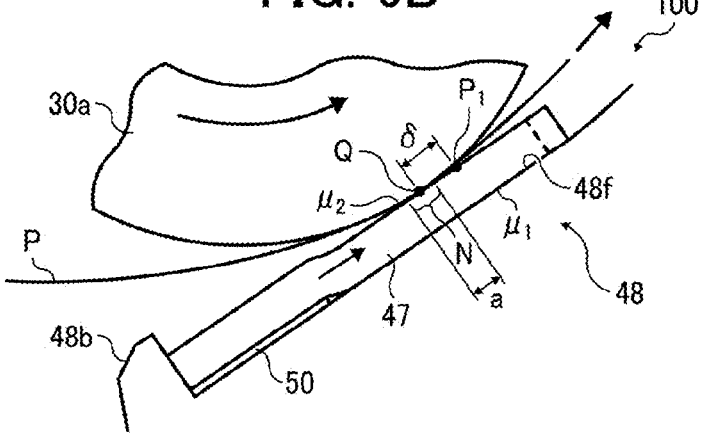
FIGS. 6B and 6C are side views of the sheet feeder illustrated in FIG. 6A, in which the friction pad is expanded and contracted, respectively.

By contrast, according to the first embodiment, as the separation pad 47 moves in the sheet conveyance direction due to expansion and contraction, the point of contact (i.e., the separation nip N) of the separation pad 47 with the feeding roller 30*a* changes as illustrated in FIGS. 6A and 6B.

In FIG. 6A, the separation pad 47 is not expanded. In this state, the contact between the separation pad 47 and the feeding roller 30*a* centers around a contact point $P_1$. Due to the elastic deformation of the separation pad 47 and the feeding roller 30*a*, the separation nip N has a range a in the sheet conveyance direction.

In FIG. 6B, the separation pad 47 is in an expanded state. In FIG. 6B, reference character $\delta$ represents an expansion amount of the separation pad 47 in this state, and the contact between the separation pad 47 and the feeding roller 30*a* is centered around a point Q shifted by the expansion amount $\delta$ upstream from the contact point $P_1$ in the sheet conveyance direction.

Figure 6C:
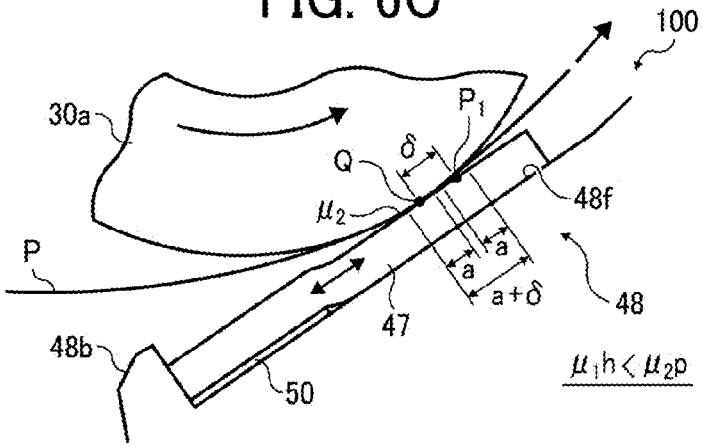

Owing to the change in position of the separation nip N on the separation pad 47, the movable range 47M of the separation pad 47 expands and contracts as illustrated in FIG. 6C, and a range that wears due to the friction between the separation pad 47 and the sheet P equals the sum of the range a and the expansion amount $\delta$ (hereinafter "wear range a+$\delta$"). The wear range a+$\delta$ can be extended by: 1) increasing the difference between the first and second friction forces $\mu_1 h$ and $\mu_2 p$; 2) reducing elasticity, that is, the modulus of longitudinal elasticity, of the separation pad 47; or 3) changing the length from the fixed range 47F of the separation pad 47 to the separation nip N.

Thus, the wear range of the separation pad 47 in the separation nip N is expanded, and accordingly progress of localized wear is inhibited. This configuration inhibits behavior changes of the sheet P in separation and the changes in conveyance conditions of the sheet P, caused by wear of the separation pad 47 over time. Accordingly, noise due to wear over time is suppressed.

Additionally, inhibition of localized wear of the separation pad 47 is effective in reducing changes in sheet separation and conveyance performances. To attain such effects, it is advantageous that the downstream end of the separation pad 47 in the sheet conveyance direction is not restricted when the separation pad 47 expands in the sheet conveyance direction.

In the description above, various aspects of the embodiments are applied to the separation pad 47 of the sheet feeder 100. This is effective because noise at the separation pad 47 of the sheet feeder 100 is typical and chronic in low-end image forming apparatuses such as printers. However, application of aspects of the present specification is not limited to the separation pad 47 of the sheet feeder 100. The aspects of the present specification are adaptable to any configuration that includes a friction pad to slidably contact a feeding member.

Second Embodiment

Figure 7A:
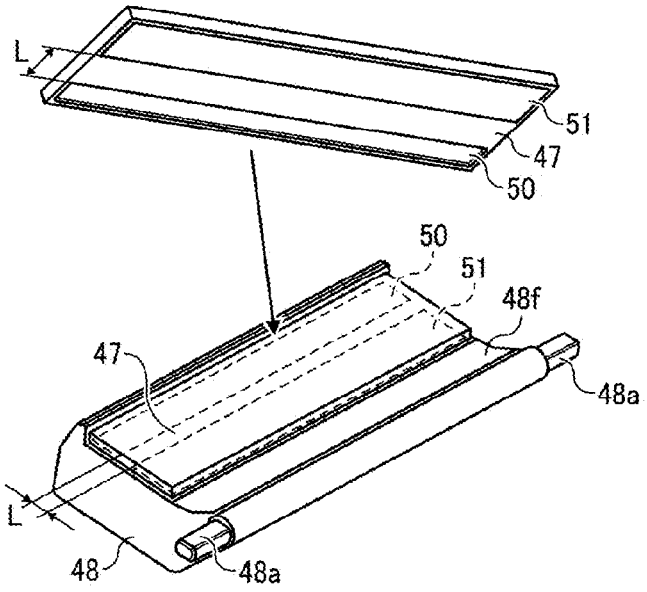
FIG. 7A is an exploded perspective view of a sheet feeder according to a second embodiment, from which a friction pad is separated.
Figure 7B:
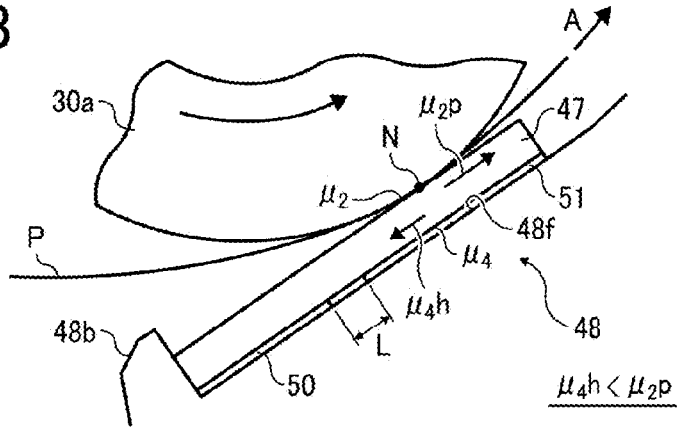
FIGS. 7B and 7C are side views of the sheet feeder illustrated in FIG. 7A.

FIGS. 7A and 7B illustrate a separation pad and adjacent portions according to a second embodiment.

In the second embodiment, an upstream portion of the separation pad 47 in the sheet conveyance direction, indicated by arrow A in FIG. 7B, is bonded to the receiving table 48 with double-sided adhesive tape 50.

Additionally, a low-friction plate 51 is interposed between the supported face of the separation pad 47 and the receiving table 48, at a distance given reference "L" in FIG. 7 A (herein after "a gap L") from the double-sided adhesive tape 50 in the sheet conveyance direction and. For example, the low-friction plate 51 is made of or includes resin. The low-friction plate 51 contacts the pad mount 48*f* of the receiving table 48. The low-friction plate 51, the pad mount 48*f*, and the separation pad 47 are configured so that a fourth friction force $\mu_4 h$ between the low-friction plate 51 and the pad mount 48*f* is smaller than the second friction force $\mu_2 p$ between the sheet P and the separation face of the separation pad 47 ($\mu_4 < \mu_2$ in the case of p=h).

In the above-described first embodiment, the supported face of the separation pad 47 that is a single component has a lower friction coefficient. This requires control of surfaces properties of both sides of the separation pad 47, and the component production is more complicated.

Additionally, elastic materials such as rubber, typically used for the separation pad 47, are susceptible to environmental changes. Thus, management of friction coefficient with the receiving table 48 is difficult. By contrast, according to the second embodiment, it is easier to maintain uniform surface contact between the low-friction plate 51 and the receiving table 48, and the friction coefficient between the components is more stable.

Additionally, the fourth friction force $\mu_4 h$ with the receiving table 48 is variable by changing the material of the low-friction plate 51. The degree of expansion and contraction of the separation pad 47 is adjustable with changes in material of the low-friction plate 51, and accordingly vibration suppression effects on the separation pad 47 and the receiving table 48 are adjustable. The fourth friction force $\mu_4 h$ is further adjustable by changing the size, shape, or arrangement of the low-friction plate 51. For example, the low-friction plate 51 may have a grid shape or a shape including multiple holes, or includes multiple strips in parallel arrangement.

Figure 7C:
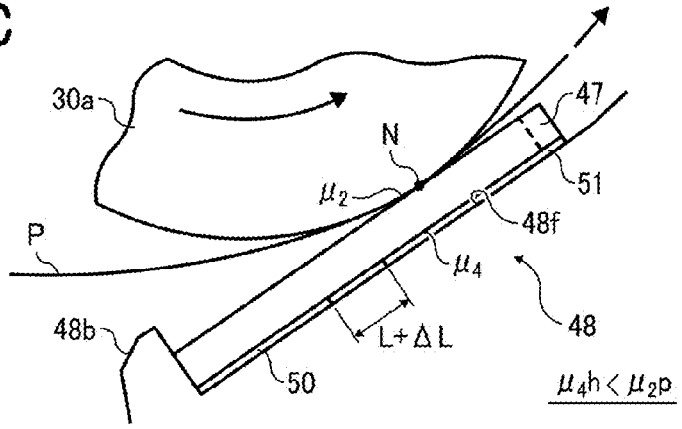

Providing the gap L between the double-sided adhesive tape 50 and the low-friction plate 51 in the sheet conveyance direction is advantageous. For example, even when the low-friction plate 51 is made of a relatively rigid material and less expendable, the gap L is expandable (from L to L+ΔL) in the sheet conveyance direction as illustrated in FIG. 7C, thus improving the above-described vibration suppression effects and durability.

Additionally, the gap L has a given length within a range from the fixed range 47F on the upstream side in the sheet conveyance direction to a position adjacent to the separation nip N. Accordingly, the degree of expansion of the separation pad 47 in the sheet conveyance direction is adjustable by adjusting the gap L in length in that direction.

Additionally, since the rigidity between the separation pad 47 and the receiving table 48 is variable with adjustment of the gap L, the eigenfrequency is variable. Additionally, this configuration allows various options regarding material, property, and the like of the low-friction plate 51. With the selection of material, vibration suppression effects can be adjusted, and the cost can be reduced.

Although resin is mentioned as an example material of the low-friction plate 51 in the description above, the material is not limited to resin. Alternatively, metal such as Steel Use Stainless (SUS or stainless steel) is usable to attain similar effects. Use of metal such as stainless steel is advantageous in increasing rigidity and durability.

Yet alternatively, instead of the low-friction plate 51, for example, a soft sheet or film such as Teflon™ sheet, Teflon tape, or the like may be used since the low-friction plate 51 is not necessarily rigid. In this case, similar effects can be attained as well.

Figure 8:
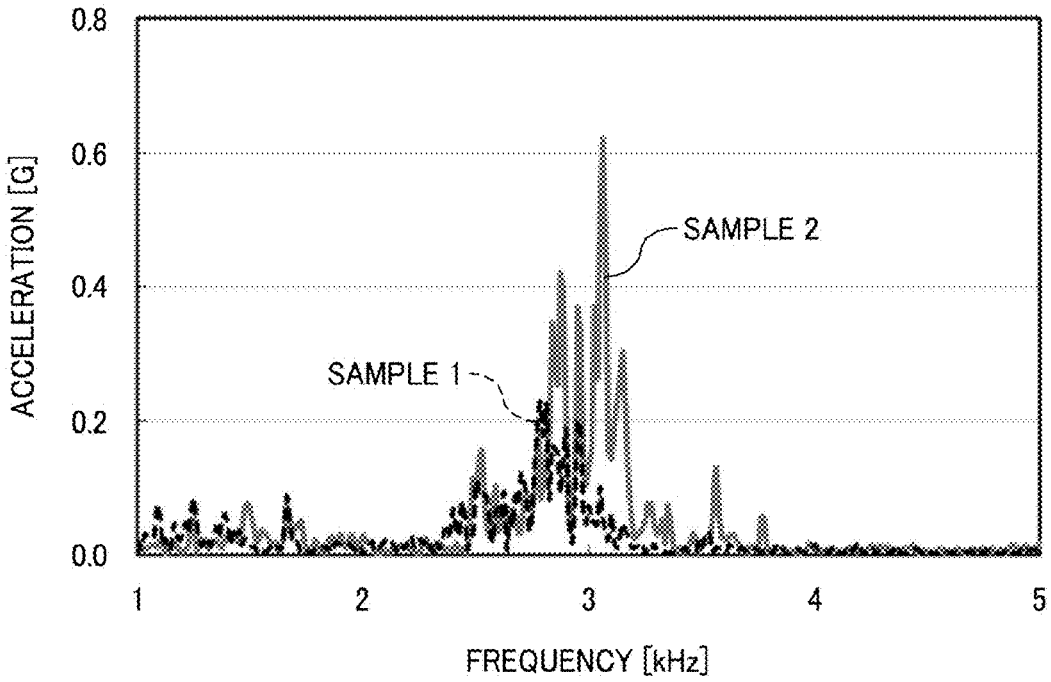
FIG. 8 is a graph of experimentally obtained vibration acceleration of a receiving table according the second embodiment.

FIG. 8 is a graph of experimentally obtained vibration acceleration of the receiving table 48 during sheet feeding. As Sample 1, the sheet feeder 100 illustrated in FIG. 7A, according to the second embodiment was used. As Sample 2, the comparative sheet feeder 100X illustrated in FIG. 5B was used.

The sheet feeder 100 illustrated in FIG. 7A and the comparative sheet feeder 100X illustrated in FIG. 5B are different from each other in the range of bonding between the separation pad 47 and the receiving table 48 using the double-sided adhesive tape 50 (partially on the upstream side or entire), the low-friction plate 51, and the gap L, but are common in other configurations and materials.

The waveshapes in FIG. 8 were obtained by: measuring vibration arising at the receiving table 48 during sheet feeding by rotation of the feeding roller 30*a* in Samples 1 and 2; and analyzing the measurements using frequency analysis based on fast Fourier transform (FFT). In FIG. 8, the abscissa represents frequency (kHz), the ordinate represents acceleration (G), broken lines represent results of Sample 1, which is the configuration illustrated in FIG. 7A according to the second embodiment, and solid lines represents results of Sample 2, which is the configuration illustrated in FIG. 5B as a comparative example.

Increases in acceleration G means increases in degree of noise. The noise is caused by vibration due to friction between the separation pad 47 and the sheet P.

From the results in FIG. 8, it is known that the vibration in the comparative example is about the triple of that in the configuration according to the second embodiment. Accordingly, the configuration according to the second embodiment is advantageous in reducing vibration. Thus, the configuration according to the second embodiment is effective in suppressing vibration caused by friction between the separation pad 47 and the sheet P and further inhibiting generation of noise.

Third Embodiment

Figure 9A:
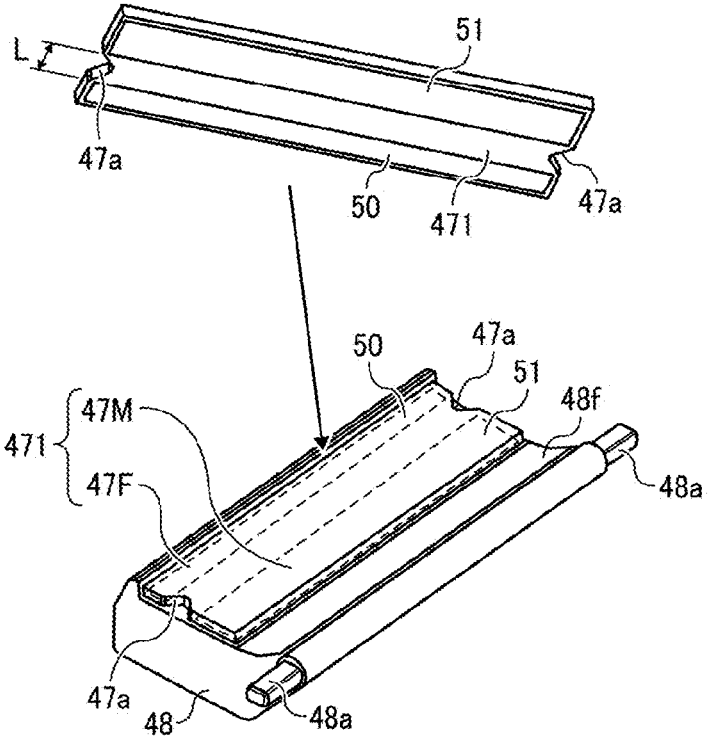
FIG. 9A is an exploded perspective view of a sheet feeder according to a third embodiment, from which a friction pad is separated.
Figure 9B:
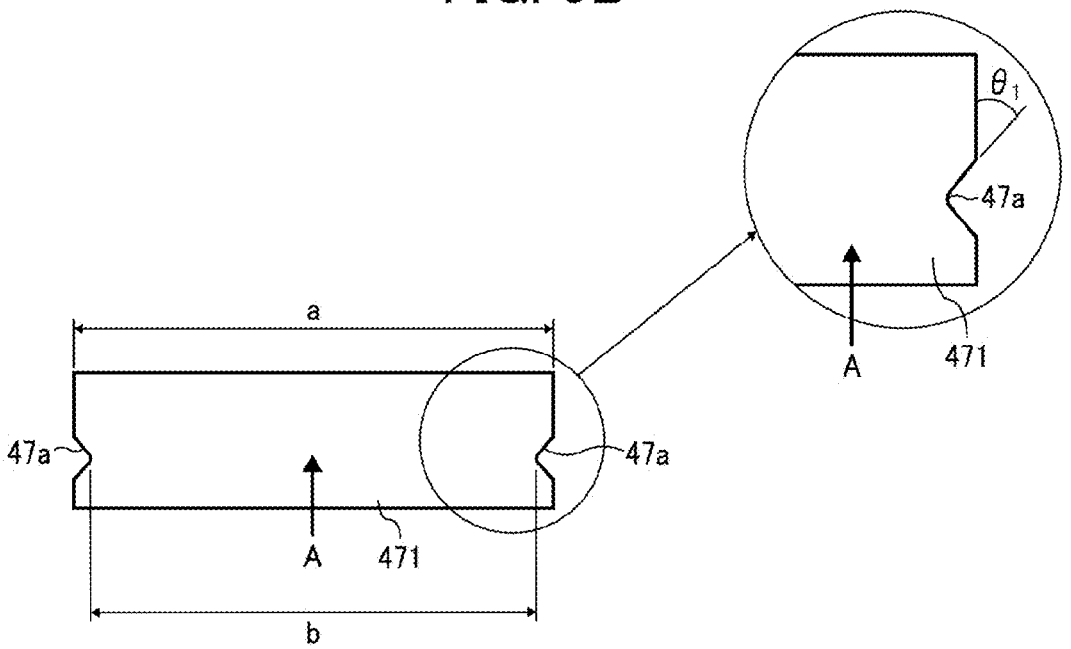
FIG. 9B is a plan view of a separation pad of the sheet feeder illustrated in FIG. 9A.

FIGS. 9A and 9B illustrate a separation pad 471 according to a third embodiment.

In the third embodiment illustrated in FIG. 9A, a notch 47*a*, serving as a different width portion, is provided at each end in a width direction of the separation pad 471 perpendicular to the sheet conveyance direction indicated by arrow A in FIG. 9B. The notches 47*a* is positioned in the gap L between the double-sided adhesive tape 50 (the fixed range 47F) and the low-friction plate 51 (the movable range 47M) in the conveyance direction.

With the notches 47*a*, a length b of the portion of the separation pad 471 in the gap L is shorter than a width a of the separation nip N.

In the configuration illustrated in FIG. 9B, the rigidity is reduced in the portion of the separation pad 471 in the gap L, and the separation pad 471 expands more easily in response to load in the sheet conveyance direction. That is, elasticity (for expansion and contraction) of the separation pad 471 is adjusted with the reduction in width of the separation pad 471 in the gap L, and the rigidity between the separation pad 471 and the receiving table 48 can be changed. Owing to the change in rigidity, the eigenfrequency of the separation pad 471 becomes variable.

Additionally, as illustrated in FIG. 9B, when the separation pad 471 includes the notch 47*a*, an edge that is at an angle with the sheet conveyance direction is present downstream from the notch 47*a* in the sheet conveyance direction. In this case, to inhibit degradation in performance of transport of sheets, it is advantageous that the notch 47*a* is inclined at an angle θ1 relative to the sheet conveyance direction.

Fourth Embodiment

Figure 10:
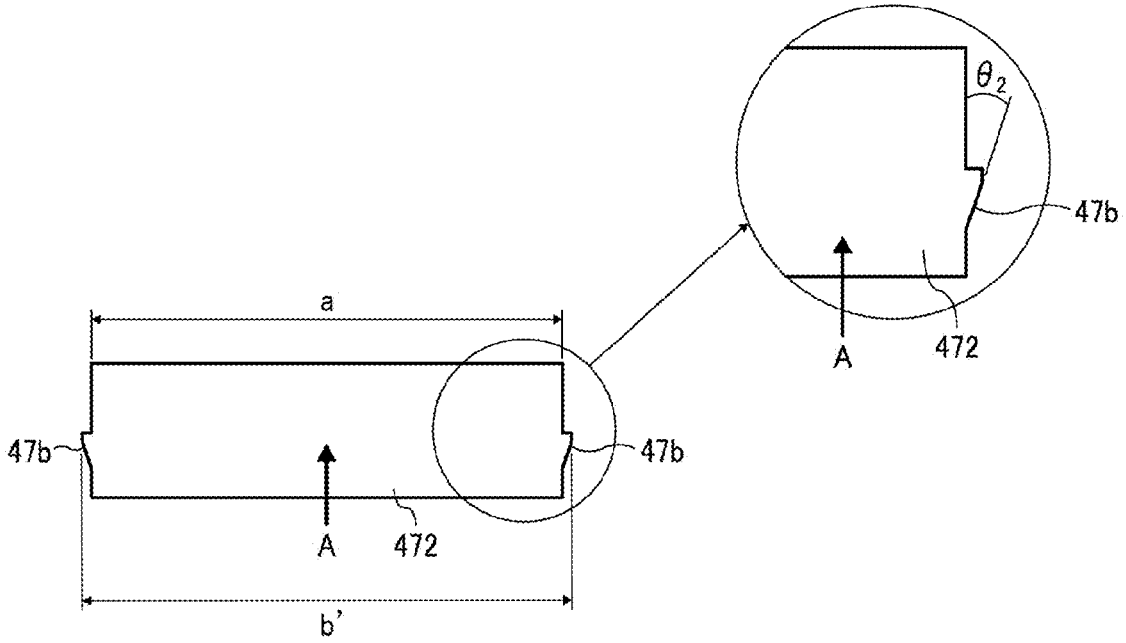
FIG. 10 is a plan view of a separation pad of a sheet feeder according to a fourth embodiment.

FIG. 10 illustrates a separation pad 472 according to a fourth embodiment.

In the fourth embodiment, differently from the third embodiment, the separation pad 472 includes a width extension 47*b* (i.e., a different width portion) at each end in the width direction of the separation pad 472 perpendicular to the sheet conveyance direction indicated by arrow A. The width extensions 47*b* are positioned in the gap L between the double-sided adhesive tape 50 and the low-friction plate 51 in the conveyance direction.

With the width extensions 47*b*, a length b' of the portion of the separation pad 472 in the gap L is longer than the width a of the separation nip N.

This configuration increases the rigidity of the separation pad 472 in the gap L, and the separation pad 472 is less likely to expand in response to load in the sheet conveyance direction. Accordingly, elasticity of the separation pad 472 can be adjusted by the increase in width of the portion facing the gap L. With this configuration, similar to the third embodiment, the rigidity between the separation pad 472 and the receiving table 48 is variable, and the eigenfrequency is variable.

Additionally, as illustrated in FIG. 10, when the separation pad 472 includes the width extension 47*b*, an edge that is at an angle with the sheet conveyance direction is present upstream from the width extension 47*b* in the sheet conveyance direction. In this case, to inhibit degradation in performance of transport of sheets, it is advantageous that the width extension 47*b* is inclined at an angle θ2 relative to the sheet conveyance direction.

Fifth Embodiment

Figure 11A:
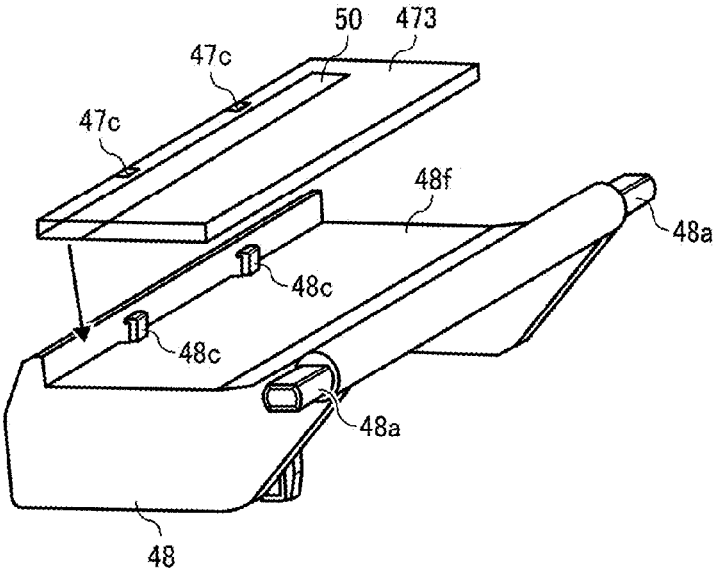
FIG. 11A is an exploded perspective view of a receiving table of a sheet feeder according to a fifth embodiment, from which a friction pad is separated.
Figure 11B:
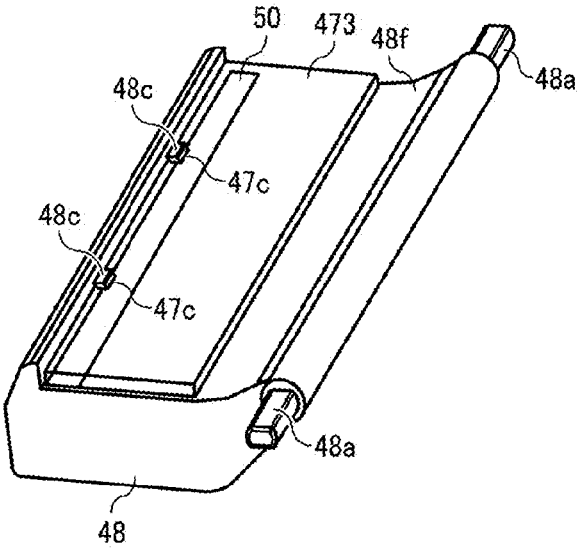
FIGS. 11B and 11C are respectively a perspective view and a plan view of an assembled state of the receiving table in FIG. 11A.
Figure 11C:
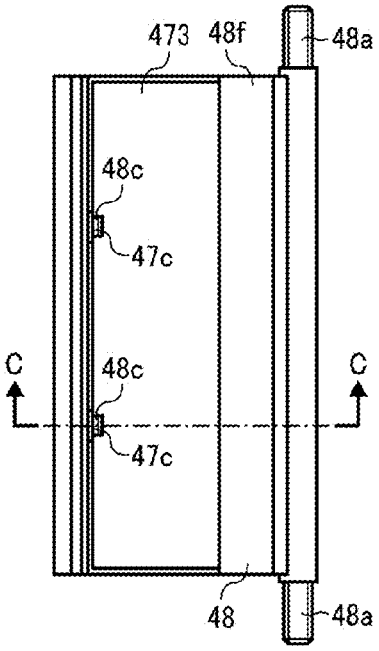
Figure 12:
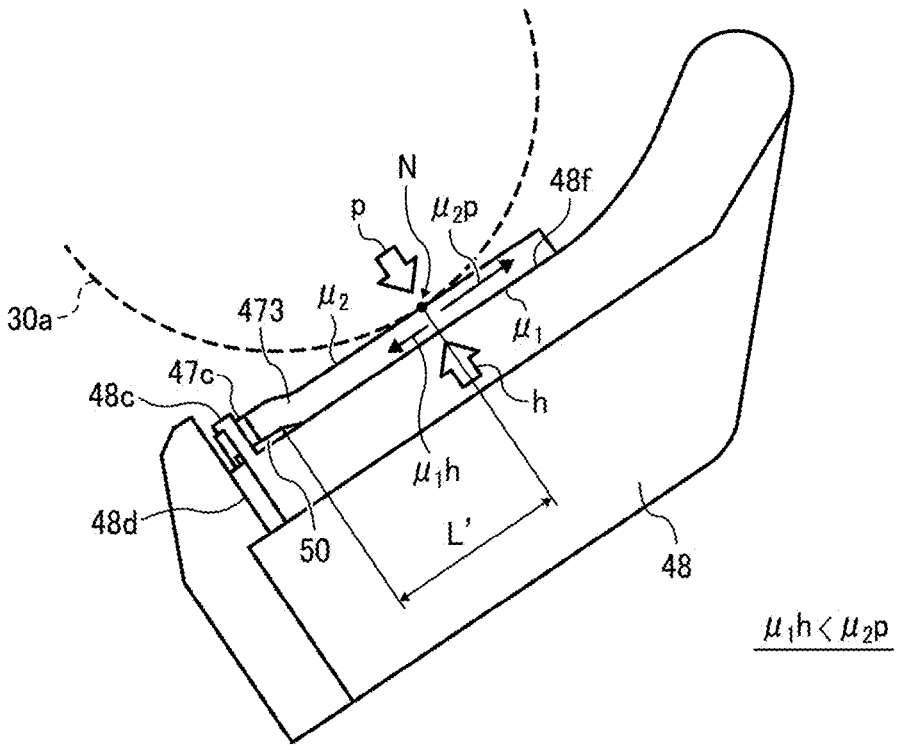
FIG. 12 is a side view of the receiving table according to the fifth embodiment.

FIGS. 11A, 11B, 11C, and 12 illustrate a separation pad 473 according to a fifth embodiment. FIG. 11C is a view of the separation pad 473 as viewed from above, and FIG. 12 is a cross-sectional view along line C-C passing through a projection 48*c*.

In the fifth embodiment, as illustrated in FIGS. 11A and 11B, the receiving table 48 includes the projections 48*c* at an upstream end of the pad mount 48*f* in the sheet conveyance direction. The projections 48*c* serve as engagement portions to hold the separation pad 473. The separation pad 473 includes engagement holes 47*c* in an upstream end portion in the sheet conveyance direction to fit the projections 48*c* of the receiving table 48.

According to the fifth embodiment, compared with the first embodiment described above, the separation pad 473 is held by the projections 48*c* in addition to the double-sided adhesive tape 50. Accordingly, the separation pad 473 is more reliably secured to the receiving table 48 even if adhesive force of the double-sided adhesive tape 50 is weak. Accordingly, the fixed range 47F fixed by the double-sided adhesive tape 50 can be reduced in length in the sheet conveyance direction. As illustrated in FIG. 12, this configuration can increase, in the sheet conveyance direction, a range L' (in FIG. 12) in which the separation pad 473 can expand and contract between the fixed range 47F and the separation nip N.

Accordingly, the adjustable range of rigidity between the separation pad 473 and the receiving table 48 increases, and flexibility in adjusting vibration suppression effects increases.

Figure 13A:
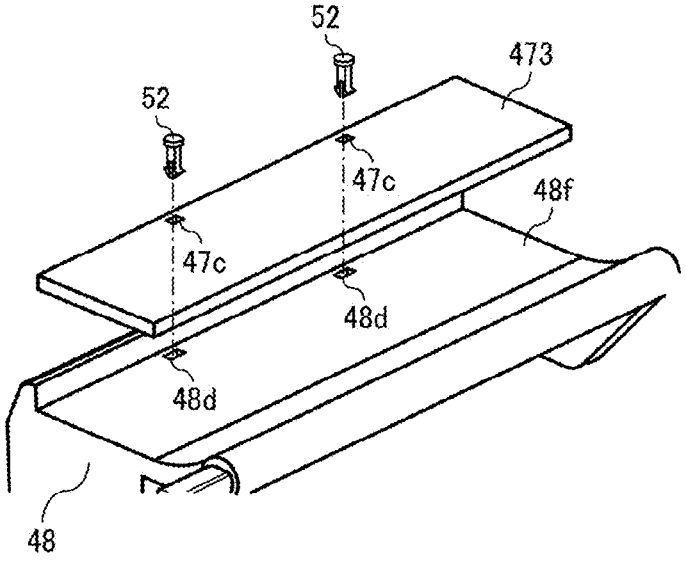
FIG. 13A is an exploded perspective view of a receiving table according to a variation of the fifth embodiment.
Figure 13B:
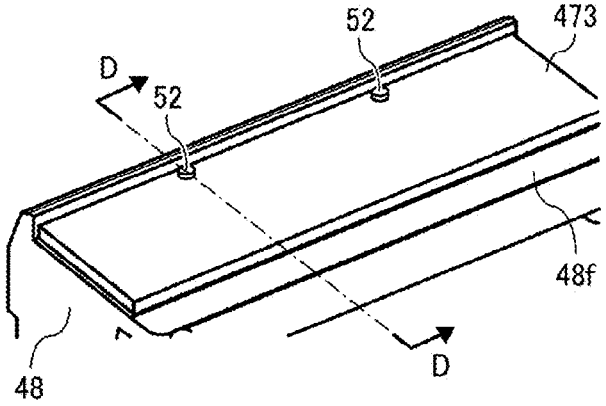
FIG. 13B is a perspective view of the receiving table according to the variation, that is assembled.
Figure 13C:
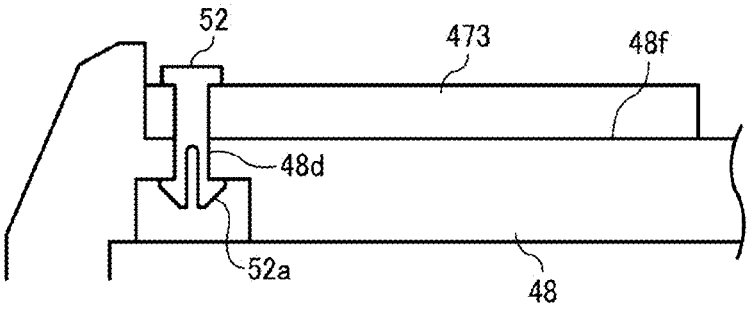
FIG. 13C is a cross-sectional view along line D-D in FIG. 13B.

FIGS. 13A, 13B, and 13C illustrate a configuration using separate pins 52 to hold the separation pad 473, as a variation of the fifth embodiment. The receiving table 48 includes pin holes 48*d* to receive the pins 52. When the pins 52 are inserted into the hole 47*c* and further into the respective pin holes 48*d* and fitted therein, the separation pad 473 is held in the pad mount 48*f* of the receiving table 48.

FIG. 13C is a cross-sectional view along line D-D passing through the pin 52 in FIG. 13B. As illustrated in FIG. 13C, the pin 52 includes a retainer 52*a* at an end thereof. The retainer 52*a* is elastically deformable in a radial direction to prevent the pin 52 from coming off the pin hole 48*d*.

With this configuration, the separation pad 473 can be secured to the receiving table 48 simply by inserting the pins 52 into the pin holes 48*d* from above the separation pad 473. In this variation, the separation pad 473 can be secured to the receiving table 48 by the pins 52 and the double-sided adhesive tape 50 can be omitted. This is advantageous in reducing the number of components, thereby making the assembling easier.

Sixth Embodiment

Figure 14A:
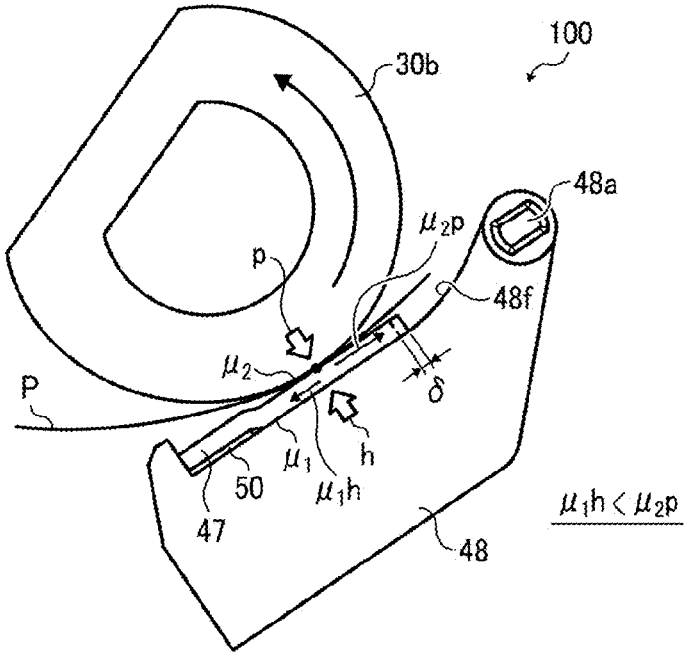
FIG. 14A is a side view of a sheet feeder according to a sixth embodiment during sheet feeding.
Figure 14B:
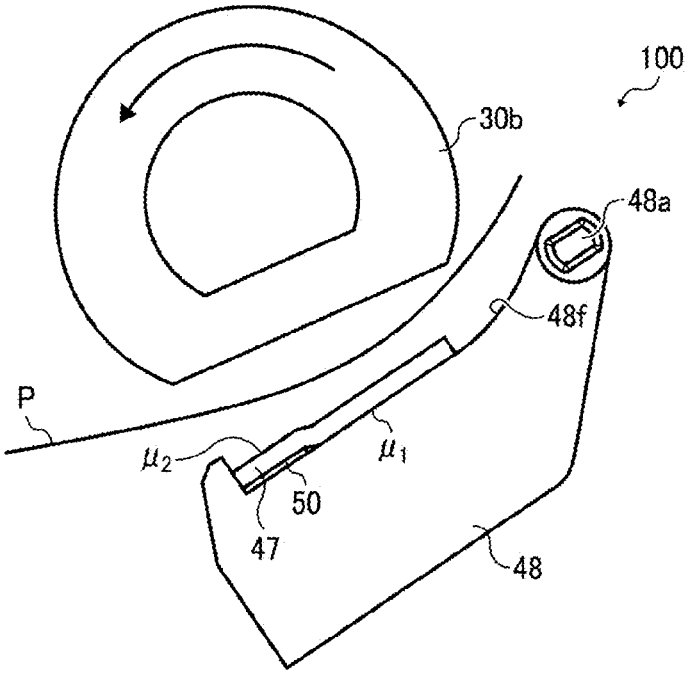
FIG. 14B is a side view of the sheet feeder illustrated in FIG. 14A, that is not feeding a sheet.

FIGS. 14A and 14B illustrate the sheet feeder 100 according to a sixth embodiment.

In the sixth embodiment, differently from the first embodiment described above, the sheet feeder 100 includes a feeding roller 30*b* having a semicircular or incomplete circular shape in cross section as if a circular segment is cut off.

When the feeding roller 30*b* is incomplete circle in cross section, the feeding roller 30*b* intermittently feeds the sheet P. As the feeding roller 30*b* rotates, a period during which the feeding roller 30*b* is pressed against the separation pad 47 via the sheet P and feeds the sheet P, as illustrated in FIG. 14A, alternates with a period during which the feeding roller 30*b* is disengaged from the separation pad 47 as illustrated in FIG. 14B.

When the feeding roller 30*b* contacts the separation pad 47 via the sheet P as illustrated in FIG. 14A, the separation pad 47 receives friction force from the sheet P, and the separation pad 47 is expanded in the sheet conveyance direction by the expansion amount δ. By contrast, in the state illustrated in FIG. 14B, in which the feeding roller 30*b* is disengaged from the separation pad 47, the leading end of the sheet P is transported by a conveyor disposed downstream from the feeding roller 30*b* in the sheet conveyance direction.

In this state, since the sheet P is not pressed against the separation pad 47, the separation pad 47 receives no or very small friction force from the sheet P. Accordingly, the expanded separation pad 47 illustrated in FIG. 14A reverts to a natural state illustrated in FIG. 14B owing to resilience of itself.

While the feeding roller 30*b* makes a complete turn, the sheet P is separated and transported in both of the separation pad 47 being in the natural state and the separation pad 47 being in the expanded state. Therefore, the sixth embodiment inhibits more reliably the localized wear of the separation nip N described above in the first embodiment.

This configuration inhibits behavior changes of the sheet P in separation and the changes in conveyance conditions of the sheet P, caused by wear of the separation pad 47 over time, thereby suppressing generation of noise due to wear over time. Additionally, inhibition of localized wear of the separation pad 47 is effective in reducing changes in sheet separation and conveyance performances.

Seventh Embodiment

Figure 15A:
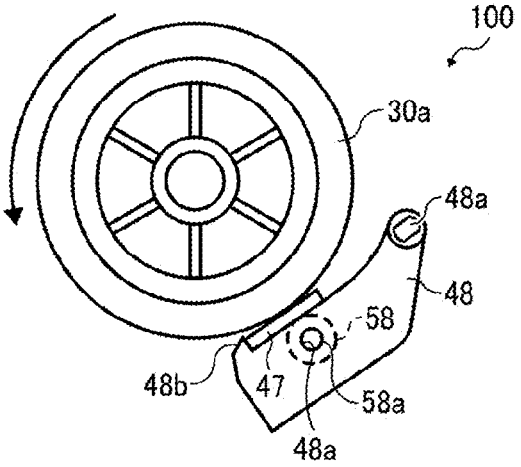
FIG. 15A is a side view of a sheet feeder according to a seventh embodiment.
Figure 15B:
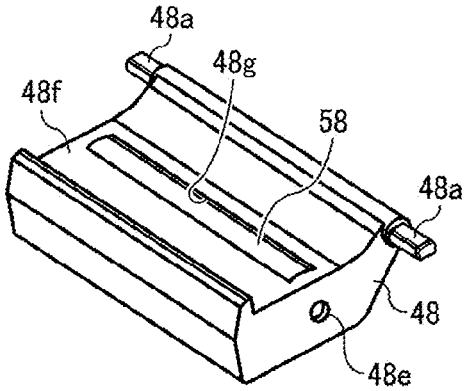
FIG. 15B is a perspective view, from above, of a receiving table without a separation pad according to the seventh embodiment.
Figure 15C:
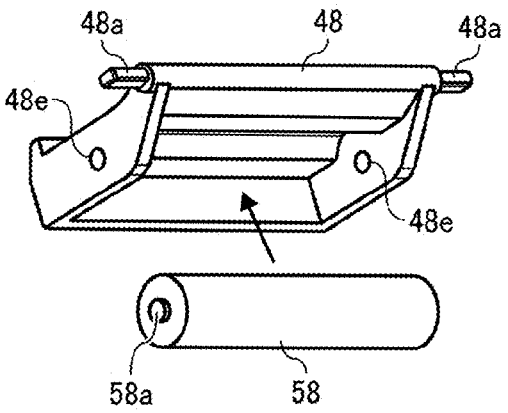
FIG. 15C is a perspective view, from below, of the receiving table without the separation pad according to the seventh embodiment.

FIGS. 15A, 15B, and 15C illustrate a sheet feeder 100 according to a seventh embodiment.

The sheet feeder 100 according to the seventh embodiment includes an idle roller 58 in the pad mount 48*f* of the receiving table 48. As illustrated in FIGS. 15B and 15C, the idle roller 58 includes a shaft 58*a* to fit in shaft holes 48*e* of the receiving table 48. When the shaft 58*a* is fitted in the shaft holes 48*e*, the idle roller 58 is rotatably attached to the receiving table 48.

Figure 15D:
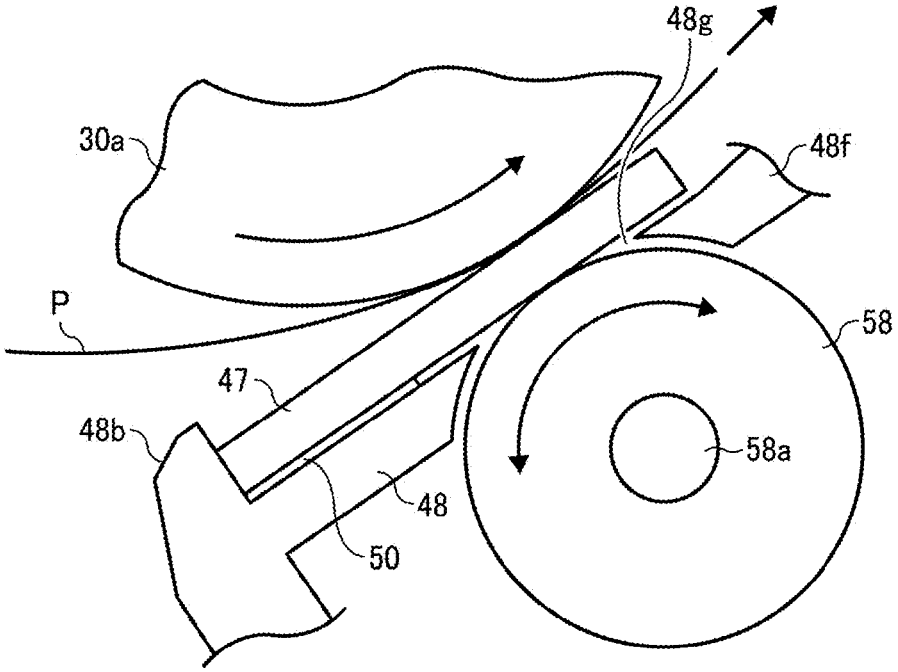
FIG. 15D is an enlarged cross-sectional view of a separation nip according to the seventh embodiment.

A circumferential face of the idle roller 58 projects upward from a slot 48*g* in the pad mount 48*f* to clamp the separation pad 47 with the feeding roller 30*a* as illustrated in FIG. 15D. That is, in the seventh embodiment, the pad mount 48*f* includes the idle roller 58 in addition to an upper face of the receiving table 48 adjoining the lower face of the movable range 47M of the separation pad 47. Compared with the first embodiment in which the separation pad 47 directly slides on the upper face of the receiving table 48, the idle roller 58 intervenes between the separation pad 47 and the upper face of the receiving table 48 in the seventh embodiment. This configuration significantly reduces the friction force between the separation pad 47 and the receiving table 48 beneath the separation nip N.

Accordingly, vibration in the sheet conveyance direction due to the friction between the separation pad 47 and the sheet P is less easily transmitted to the receiving table 48 in the separation nip N. This configuration inhibits generation of noise during separation of sheets.

Although the idle roller 58 reduces the friction between the separation pad 47 and the receiving table 48 in the seventh embodiment, alternatively, for example, an elastic body deformable in the sheet conveyance direction may be disposed between the separation pad 47 and the receiving table 48. Since the elastic body prompts deformation of the separation pad 47 in the sheet conveyance direction, the elastic body is effective in reducing friction similar to the idle roller 58.

Numerous additional modifications to the above-described embodiments and variations are possible. It is therefore to be understood that, within the scope of the appended claims, the disclosure of this patent specification may be practiced otherwise than as specifically described herein. For example, the nip is not limited to the separation nip N to separate the top sheet from a bundle of sheets so that the sheets are fed one by one. The nip may be configured to transport the sheets one by one while braking on the sheet.

What is claimed is:

1. A sheet feeder comprising:

a feeding member to contact a sheet and feed the sheet downstream in a sheet conveyance direction;

a friction pad disposed facing the feeding member to contact the feeding member, and a receiving table including a pad mount to hold a side of the friction pad opposite the nip, the friction pad including:

a fixed range portion secured to the pad mount upstream in the sheet conveyance direction from a nip between the friction pad and the feeding member, and a movable range portion movable in the sheet conveyance direction and extending from the nip downstream in the sheet conveyance direction, and wherein a first friction force of the pad mount to act on the movable range portion of the friction pad is smaller than a second friction force of the sheet to act on the movable range portion of the friction pad.

2. The sheet feeder according to claim 1, wherein the friction pad comprises an elastic body to expand and contract between the fixed range portion and the movable range portion in the sheet conveyance direction due to a difference between the first friction force and the second friction force.

3. The sheet feeder according to claim 2, further comprising a low-friction plate disposed between the movable range portion of the friction pad and the pad mount, the low-friction plate lower in friction coefficient to make the first friction force smaller than the second friction force.

4. The sheet feeder according to claim 3, wherein the low-friction plate is disposed at a distance from the fixed range portion in the sheet conveyance direction.

5. The sheet feeder according to claim 2, wherein the pad mount comprises an idle roller to clamp the friction pad together with the feeding member, the idle roller to make the first friction force smaller than the second friction force.

6. The sheet feeder according to claim 2; wherein the pad mount comprises an engagement portion in an upstream end portion in the sheet conveyance direction, and the friction pad comprises an engagement portion in an upstream end portion in the sheet conveyance direction to engage the engagement portion of the pad mount.

7. The sheet feeder according to claim 2, wherein the friction pad comprises a different width portion positioned between the fixed range portion and the movable range portion in the sheet conveyance direction, the different width portion different in length in a width direction perpendicular to the sheet conveyance direction.

8. The sheet feeder according to claim 2, wherein the feeding member is semicircular in cross section such that a circular segment is cut off from a circle.

9. The sheet feeder according to claim 1, wherein the pad mount comprises an engagement portion in an upstream end portion in the sheet conveyance direction, and the friction pad comprises an engagement portion in an upstream end portion in the sheet conveyance direction to engage the engagement portion of the pad mount.

10. The sheet feeder according to claim 9, wherein the friction pad comprises a different width portion positioned between the fixed range portion and the movable range portion in the sheet conveyance direction, the different width portion different in length in a width direction perpendicular to the sheet conveyance direction.

11. The sheet feeder according to claim 10, wherein the feeding member is semicircular in cross section such that a circular segment is cut off from a circle.

12. The sheet feeder according to claim 1, wherein the friction pad comprises a different width portion positioned between the fixed range portion and the movable range portion in the sheet conveyance direction, the different width portion different in length in a width direction perpendicular to the sheet conveyance direction.

13. The sheet feeder according to claim 1, wherein the feeding member is semicircular in cross section such that a circular segment is cut off from a circle.

14. An image forming apparatus comprising:

a sheet tray to contain to contain multiple sheets of recording media;

a sheet feeder to feed the sheet from the sheet tray, the sheet feeder including:

a feeding member to contact a sheet and feed the sheet downstream in a sheet conveyance direction;

a friction pad disposed facing the feeding member to contact the feeding member, and a receiving table including a pad mount to hold a side of the friction pad opposite the nip;

an image forming unit to form an image on the sheet; and an ejection device to eject the sheet outside the image forming apparatus, wherein the friction pad includes a fixed range portion secured to the pad mount upstream in the sheet conveyance direction from a nip between the friction pad and the feeding member, and a movable range portion movable in the sheet conveyance direction and extending from the nip downstream in the sheet conveyance direction, and a first friction force of the pad mount to act on the movable range portion of the friction pad is smaller than a second friction force of the sheet to act on the movable range portion of the friction pad.

15. The image forming apparatus according to claim 14, wherein the image forming apparatus has at least two of copying, facsimile transmission, printing, and inkjet recording capabilities.

16. The sheet feeder according to claim 1, wherein the fixed range portion is secured to the pad mount by a double-sided adhesive tape.

17. The sheet feeder according to claim 1, wherein the movable range portion is free of any securement members.

* * * * *